US009466280B2

(12) United States Patent
Kawka et al.

(10) Patent No.: US 9,466,280 B2
(45) Date of Patent: Oct. 11, 2016

(54) ACOUSTIC DEVICE SUSPENSION

(71) Applicant: Bose Corporation, Framingham, MA (US)

(72) Inventors: Marek Kawka, Bolton, MA (US); Yang Liu, Sudbury, MA (US); Christopher A. Pare, Franklin, MA (US)

(73) Assignee: Bose Corporation, Framingham, MA (US)

( * ) Notice: Subject to any disclaimer, the term of this patent is extended or adjusted under 35 U.S.C. 154(b) by 14 days.

(21) Appl. No.: 14/522,770

(22) Filed: Oct. 24, 2014

(65) Prior Publication Data

US 2016/0118032 A1 Apr. 28, 2016

(51) Int. Cl.

| | |
|---|---|
| ***H04R 9/06*** | (2006.01) |
| ***G10K 11/00*** | (2006.01) |
| ***H04R 9/04*** | (2006.01) |
| ***H04R 7/20*** | (2006.01) |
| ***H04R 7/18*** | (2006.01) |

(52) U.S. Cl.

CPC ..... *G10K 11/002* (2013.01); *H04R 7/18* (2013.01); *H04R 7/20* (2013.01); *H04R 9/043* (2013.01); *H04R 2231/003* (2013.01); *H04R 2307/207* (2013.01)

(58) Field of Classification Search

CPC ..... H04R 7/14; H04R 7/16; H04R 7/18; H04R 7/20; H04R 9/041; H04R 9/043; H04R 9/045; H04R 9/06; H04R 2231/003; H04R 2307/207; H04R 2400/07

USPC ..... 381/396, 398, 403, 404, 405, 423, 424, 381/430, 432, 433; 181/171, 172

See application file for complete search history.

(56) References Cited

U.S. PATENT DOCUMENTS

| | | | | |
|---|---|---|---|---|
| 5,847,333 | A * | 12/1998 | D'Hoogh | H04R 7/20 181/156 |
| 5,883,967 | A * | 3/1999 | House | H04R 7/14 381/398 |
| 6,044,925 | A | 4/2000 | Sahyoun | |
| 6,160,898 | A | 12/2000 | Bachmann et al. | |
| 6,457,548 | B1 | 10/2002 | D'Hoogh | |
| 6,460,651 | B1 | 10/2002 | Sahyoun | |
| 6,490,363 | B1 | 12/2002 | Liu | |
| 6,626,263 | B2 | 9/2003 | Sahyoun | |
| 6,658,129 | B2 | 12/2003 | D'Hoogh | |
| 6,675,931 | B2 | 1/2004 | Sahyoun | |
| 6,700,987 | B2 | 3/2004 | Kuze et al. | |
| 7,318,496 | B2 | 1/2008 | Sahyoun | |
| 7,418,107 | B2 | 8/2008 | Milot et al. | |
| 7,428,946 | B2 | 9/2008 | Honda et al. | |
| 7,974,434 | B2 * | 7/2011 | Funahashi | H04R 9/043 381/398 |
| 8,019,112 | B2 | 9/2011 | Milot et al. | |
| 8,073,186 | B2 | 12/2011 | Milot et al. | |
| 2005/0141746 | A1 * | 6/2005 | Kobayashi | H04R 9/041 381/424 |
| 2012/0002836 | A1 | 1/2012 | Milot et al. | |

FOREIGN PATENT DOCUMENTS

| | | | |
|---|---|---|---|
| CN | 201440722 | U | 4/2010 |
| JP | 4377243 | B2 | 12/2009 |
| JP | 4624468 | B2 | 2/2011 |

* cited by examiner

*Primary Examiner* — Huyen D Le

(57) ABSTRACT

An acoustic device includes a diaphragm, a frame, and a suspension element that couples the diaphragm to the frame such that the diaphragm is movable in a reciprocating manner relative to the frame. The suspension element includes a first surround element and a second surround element that are separated at respective outer edges by a first distance and separated at respective inner edges by a second distance. The first distance and the second distance are different.

15 Claims, 11 Drawing Sheets

ACOUSTIC DEVICE SUSPENSION

BACKGROUND

This disclosure relates to a suspension for an acoustic device.

SUMMARY

In accordance with a first aspect, an acoustic device includes a diaphragm, a frame, and a suspension element that couples the diaphragm to the frame such that the diaphragm is movable in a reciprocating manner relative to the frame. The suspension element includes a first surround element and a second surround element that are separated at respective outer edges by a first distance and separated at respective inner edges by a second distance. The first distance and the second distance are different.

In some implementations of the first aspect, the first distance is greater than the second distance.

In some implementations of the first aspect, the second distance comprises a thickness of the diaphragm.

In some implementations of the first aspect, the acoustic device includes a spacer element that is disposed between the first surround element and the second surround element. The first distance may be a thickness of the spacer element. The spacer element may be formed of a porous or non-porous material. The spacer element may include one or a plurality of vents.

In some implementations of the first aspect, each of the first surround element and the second surround element includes a respective outer landing that is defined in part by a respective outer edge, and the spacer element is disposed between the outer landings of the first surround element and the second surround element;

In some implementations of the first aspect, each of the first surround element and the second surround element includes a respective inner landing that is defined in part by a respective inner edge, the diaphragm is disposed between the inner landings of the first surround element and the second surround element, and the first surround element and the second surround element are arranged such that a midline of the inner landings of the surround elements is aligned with the midline of the outer landings of the surround elements.

In some implementations of the first aspect, the frame of the acoustic device includes a first frame element that is coupled to an outer landing of the first surround element, and a second frame element that is coupled to an outer landing of the second surround element. The frame may further include a third frame element that couples the first frame element to the second frame element, wherein the first distance is defined at least in part by a dimension of the third frame element. In some implementations of the first aspect, the first frame element, the second frame element and the third frame element form an integral unit. In some implementations of the first aspect, the diaphragm is disposed between respective inner landings of the first surround element and the second surround element, and the first surround element and the second surround element are arranged such that a midline of the inner landings of the surround elements is aligned with the midline of the outer landings of the surround elements.

In some implementations of the first aspect, the first surround element comprises a half-roll that defines a concave surface and a convex surface, the second surround element comprises a half-roll that defines a concave surface and a convex surface, and the first surround element and the second surround element are arranged such that the respective concave surfaces face each other and the respective convex surfaces face away from each other.

In some implementations of the first aspect, the first surround element comprises a polygon that defines a concave surface and a convex surface, the second surround element comprises a polygon that defines a concave surface and a convex surface, and the first surround element and the second surround element are arranged such that the respective concave surface face each other and the respective convex surfaces face away from each other.

In accordance with a second aspect, an acoustic device includes a diaphragm, a frame, and a suspension element that couples the diaphragm to the frame such that the diaphragm is movable in a reciprocating manner relative to the frame. The suspension element comprises a first surround element and a second surround element that are separated at respective outer edges by a first distance and separated at respective inner edges by a second distance, wherein the first distance and the second distance are different, and wherein a midline between the inner edges is aligned with a midline between the outer edges.

In some implementations of the second aspect, the first distance is greater than the second distance.

In some implementations of the second aspect, second distance comprises a thickness of the diaphragm.

In some implementations of the second aspect, the acoustic device further includes a spacer element that is disposed between the first surround element and the second surround element, and the first distance comprises a thickness of the spacer element.

In some implementations of the second aspect, the frame includes a first frame element that is coupled to an outer landing of the first surround element, and a second frame element that is coupled to an outer landing of the second surround element.

In some implementations of the second aspect, the frame further includes a third frame element that couples the first frame element to the second frame element. In some implementations of the second aspect, the first distance is defined at least in part by a dimension of the third frame element. In some implementations of the second aspect, the first frame element, the second frame element and the third frame element form an integral unit.

In some implementations of the second aspect, the first surround element comprises a half-roll that defines a concave surface and a convex surface, the second surround element comprises a half-roll that defines a concave surface and a convex surface, and the first surround element and the second surround element are arranged such that the respective concave surfaces face each other and the respective convex surfaces face away from each other.

In some implementations of the second aspect, the first surround element comprises a polygon that defines a concave surface and a convex surface, the second surround element comprises a polygon that defines a concave surface and a convex surface, and the first surround element and the second surround element are arranged such that the respective concave surface face each other and the respective convex surfaces face away from each other.

Advantages of implementations include one or more of the following. Rocking, which has undesirable acoustic effects, is reduced by separating the outer edges of the suspension element by a distance that is different from that of the inner edges of the suspension element. An acoustic device that includes a single suspension element (such as a surround) that implements this uneven separation is able to reduce rocking, and thus achieve improved stability, in a manner similar to acoustic devices that include both a surround and a spider. Elimination of the spider while continuing to achieve stability targets results in a compact design. In addition, separating the pair of surround elements at one or the other of the inner edge and the outer edge by a spacer element increases the volume contained within the suspension element and lowers the pressure within the acoustic device without requiring that the height of each surround element be increased in a manner that results in an increase in the overall package size.

All examples and features mentioned above can be combined in any technically possible way. Other features and advantages will be apparent from the description and the claims.

DESCRIPTION

Figure 1:
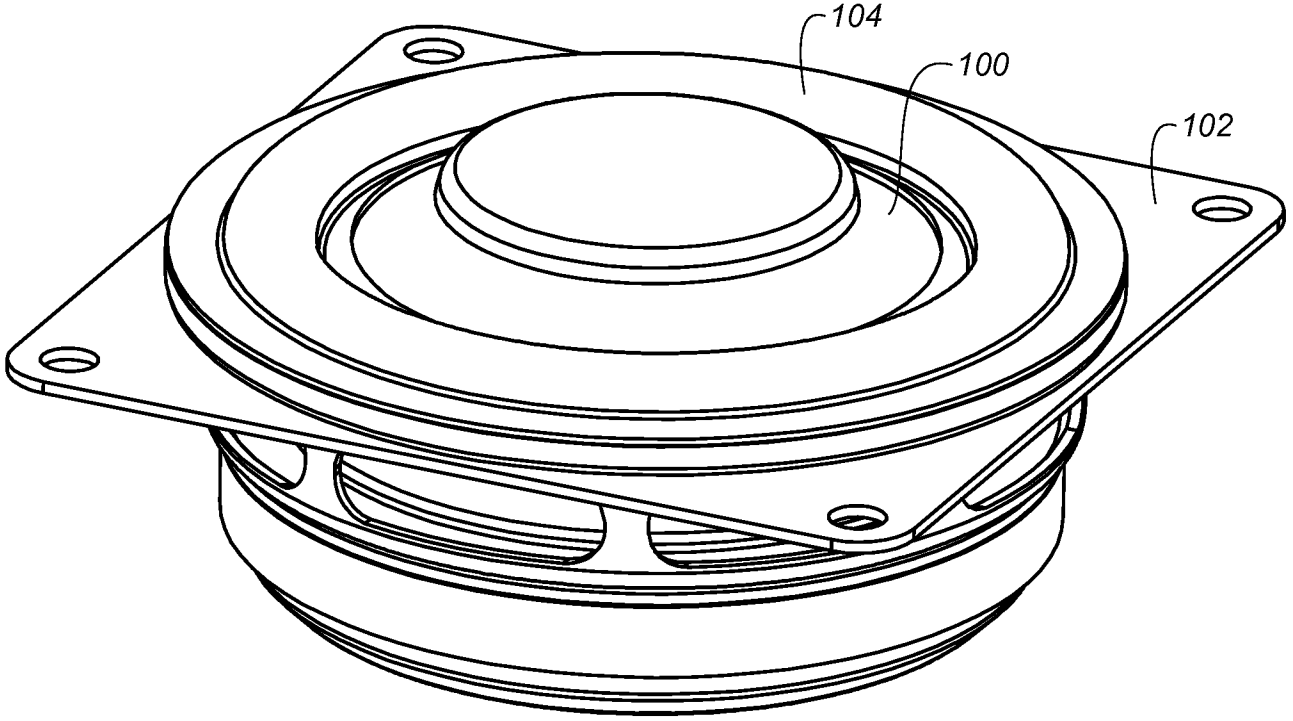
FIG. 1 is a perspective view of an acoustic device with a suspension element that includes a spacer element.
Figure 2:
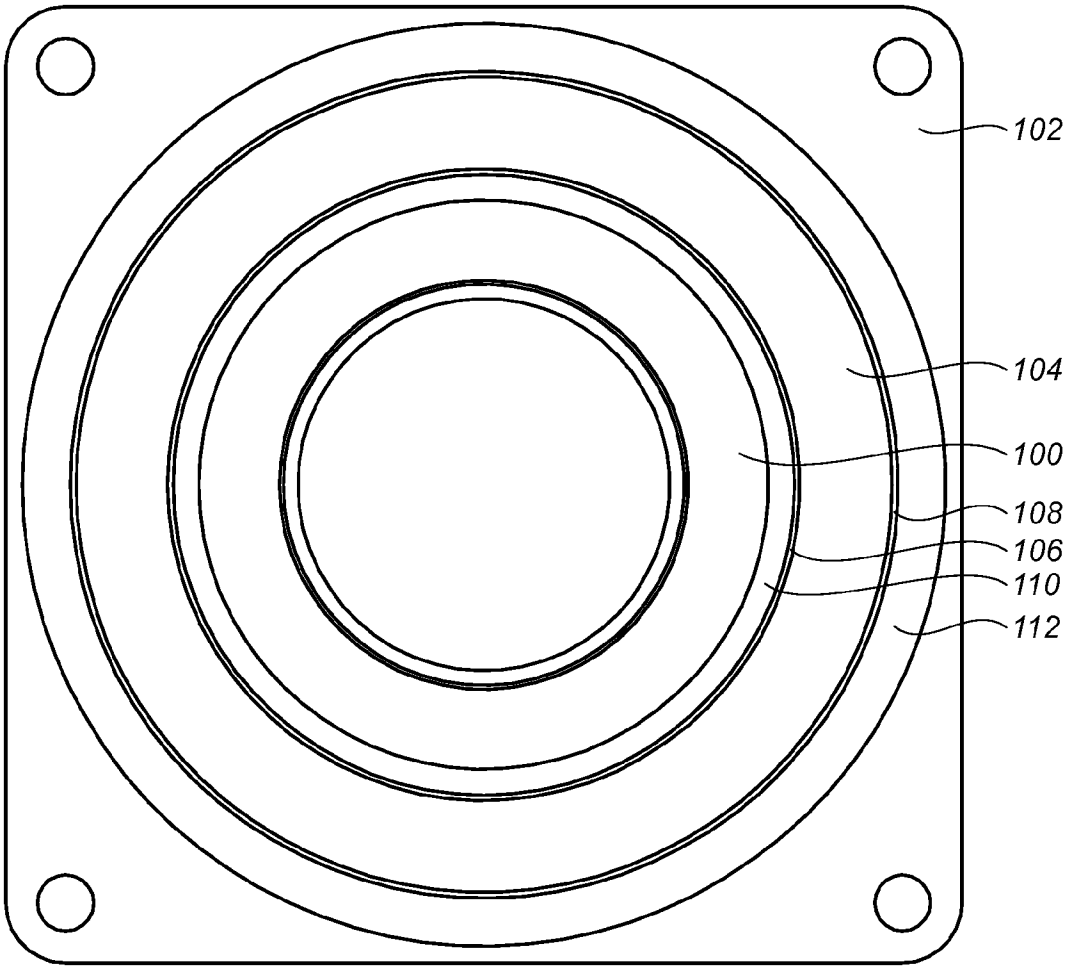
FIG. 2 is a top view of the acoustic device of FIG. 1.

FIG. 1 illustrates an acoustic device such as a loudspeaker, driver or transducer. The acoustic device includes a diaphragm 100 (sometimes referred to as a cone, plate, cup or dome) coupled to a frame 102 via a suspension element 104 sometimes referred to as a surround. The diaphragm may be circular or non-circular in shape. For example, and without limitation, the diaphragm could be an ellipse, square, rectangle, oblong, or racetrack. The frame 102 may be coupled to an acoustic enclosure box (not illustrated). The suspension element 104 allows the diaphragm 100 to move in a reciprocating manner relative to the frame 102 and enclosure in response to an excitation signal provided to a motor that outputs a force to diaphragm 100. Movement of the diaphragm causes changes in air pressure which result in production of sound.

In some examples, as shown in FIGS. 1, 2, 3A and 3B, the suspension element 104 is formed by a pair of opposing and generally circular half roll surround elements each having an inner edge 106 and an outer edge 108, separated by a radial width or span. The suspension element 104 includes an inner landing 110 extending radially inward from the inner edge 106 and an outer landing 112 extending radially outward from the outer edge 108 for connection to the diaphragm 100 and frame 102, respectively. The suspension elements 104 can be connected to the diaphragm 100 and the frame 102 using any suitable method, including use of an adhesive or by melting the suspension element material to the diaphragm/frame, to name two examples. Each half roll surround element has a convex surface 302 facing away from the interior of the enclosure, and a concave surface 304 (shown in FIGS. 3A and 3B) facing toward the interior of the volume enclosed by the two surround elements. Although the suspension element 104 is shown as a full roll having a single convolution, the suspension element 104 could be, without limitation, an inverted half roll (i.e., flipped over 180 degrees) or a roll having multiple convolutions, and could include variations of concavity and other features. A "convolution" as used herein comprises one cycle of a possibly repeating structure, where the structure typically comprises concatenated sections of arcs. The arcs are generally circular, but can have any curvature. Further, although the suspension element 104 is shown as circular in shape, the suspension element 104 could also be non-circular in shape. For example, without limitation, the suspension element 104 could be an ellipse, toroid, square, rectangle, oblong, racetrack, or other non-circular shapes. In places where the terms circumferential, radial, or other circle-specific terminology is mentioned, it should be understood that we also mean to encompass non-circular geometries.

The suspension element 104 may be made from any suitable material, including, but not limited to, fabric, rubber, foam, metal, or polyurethane plastic, such as thermoplastic polyurethane. In some implementations, the suspension element 104 includes rib and groove features (not shown) which may enhance axial stiffness, free length, force-deflection relationships, and buckling resistance, and may reduce the overall mass of the suspension element. For example, the suspension element 104 may include one or more radial rib features, groove features, and rib-and-groove features. Examples of these features are described in U.S. application Ser. No. 14/086,284, which is incorporated herein by reference in its entirety.

Figure 3A:
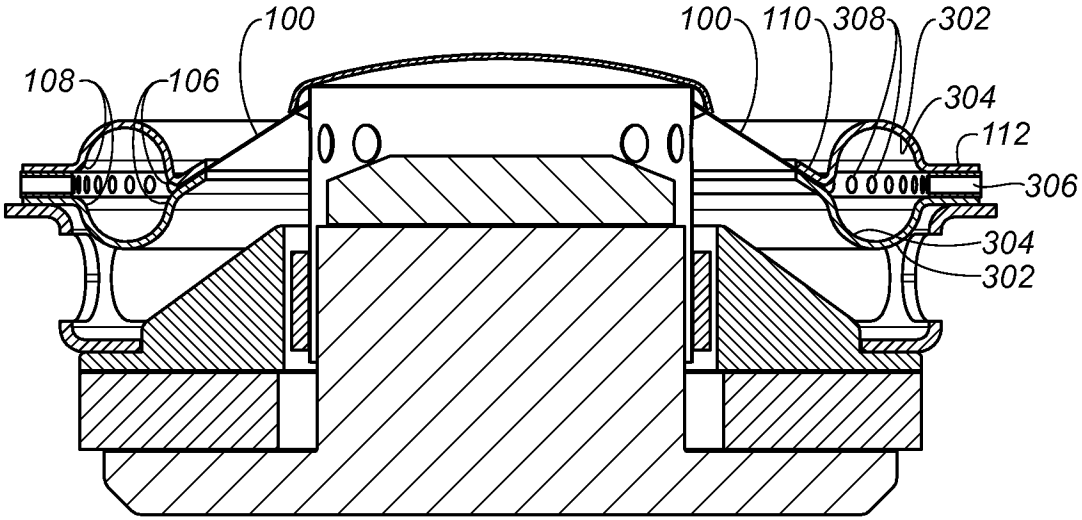
FIGS. 3A, 4A, and 5A each show a cross-sectional view of an acoustic device with a suspension element that includes a spacer element.
Figure 3B:
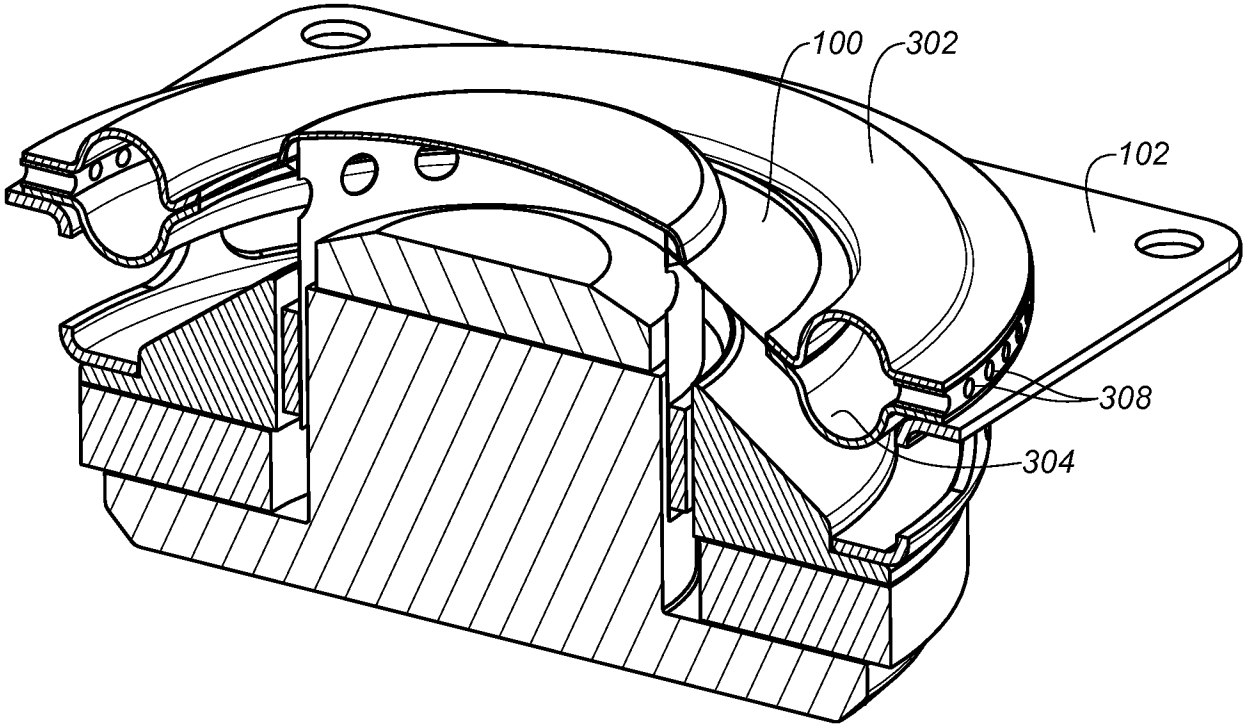
FIGS. 3B, 4B, and 5B each show a perspective view of the acoustic devices of FIGS. 3A, 4A, and 5A, respectively.
Figure 4A:
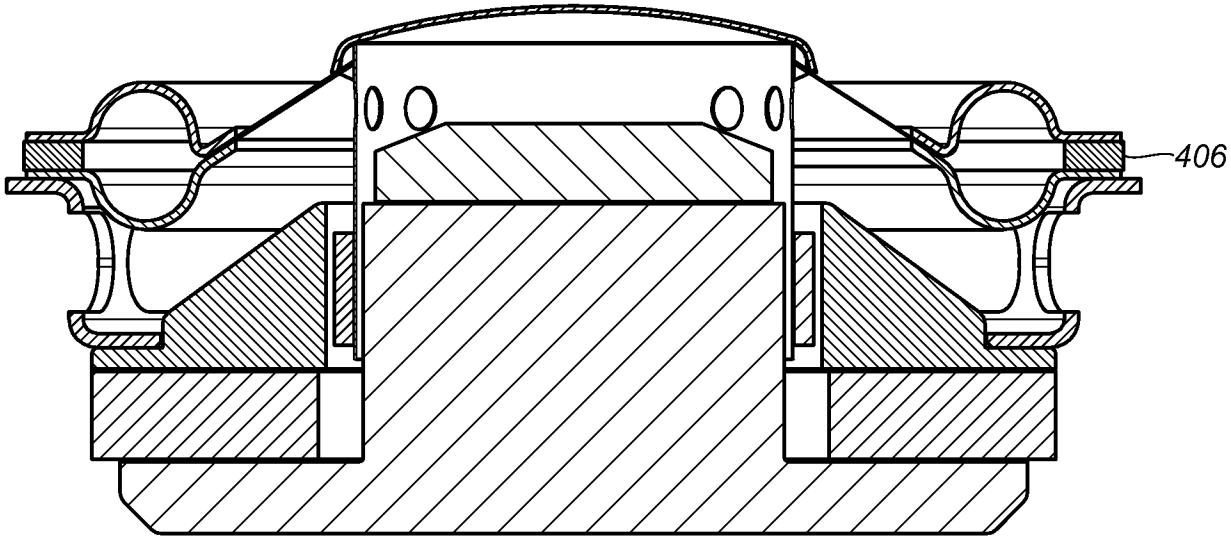
Figure 4B:
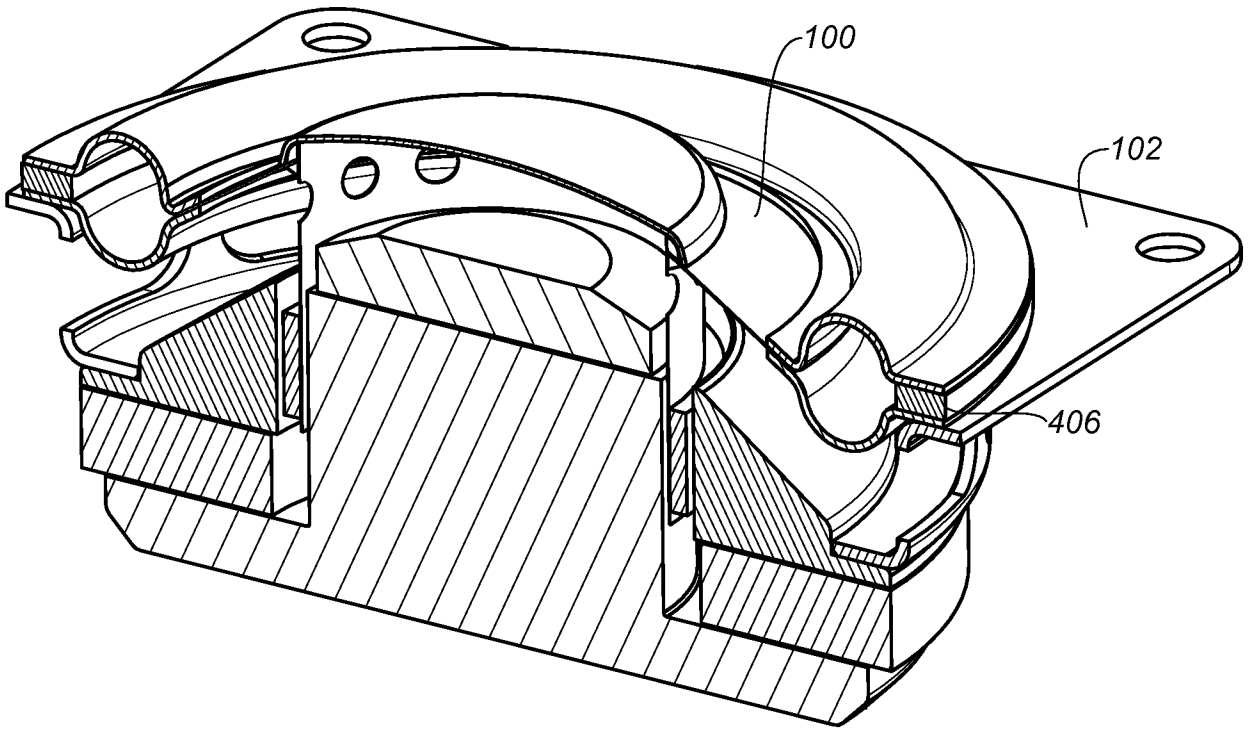
Figure 5A:
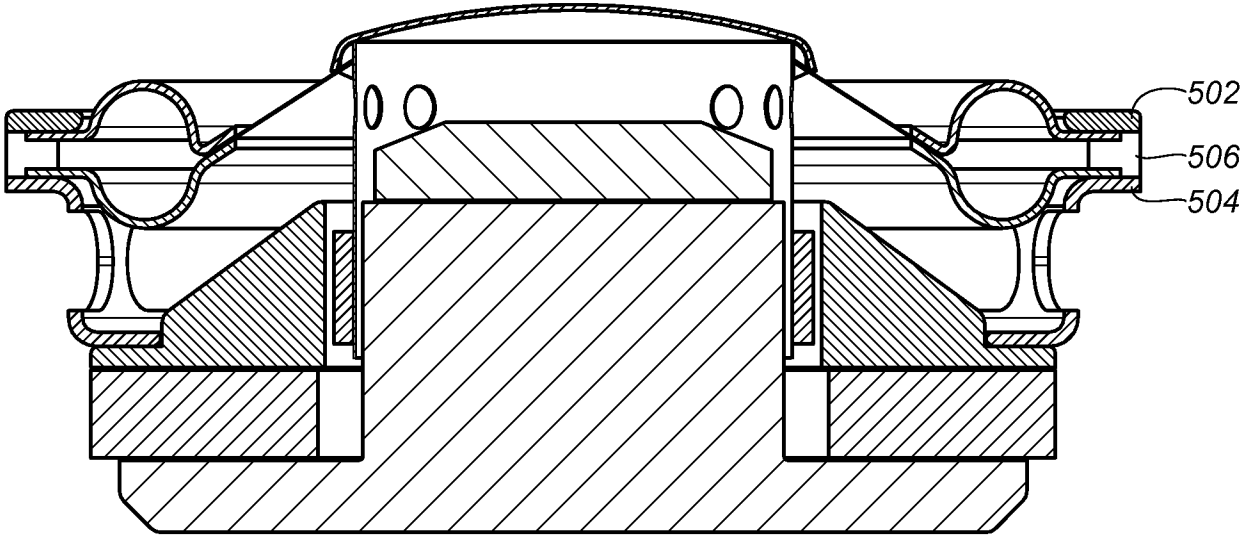
Figure 5B:
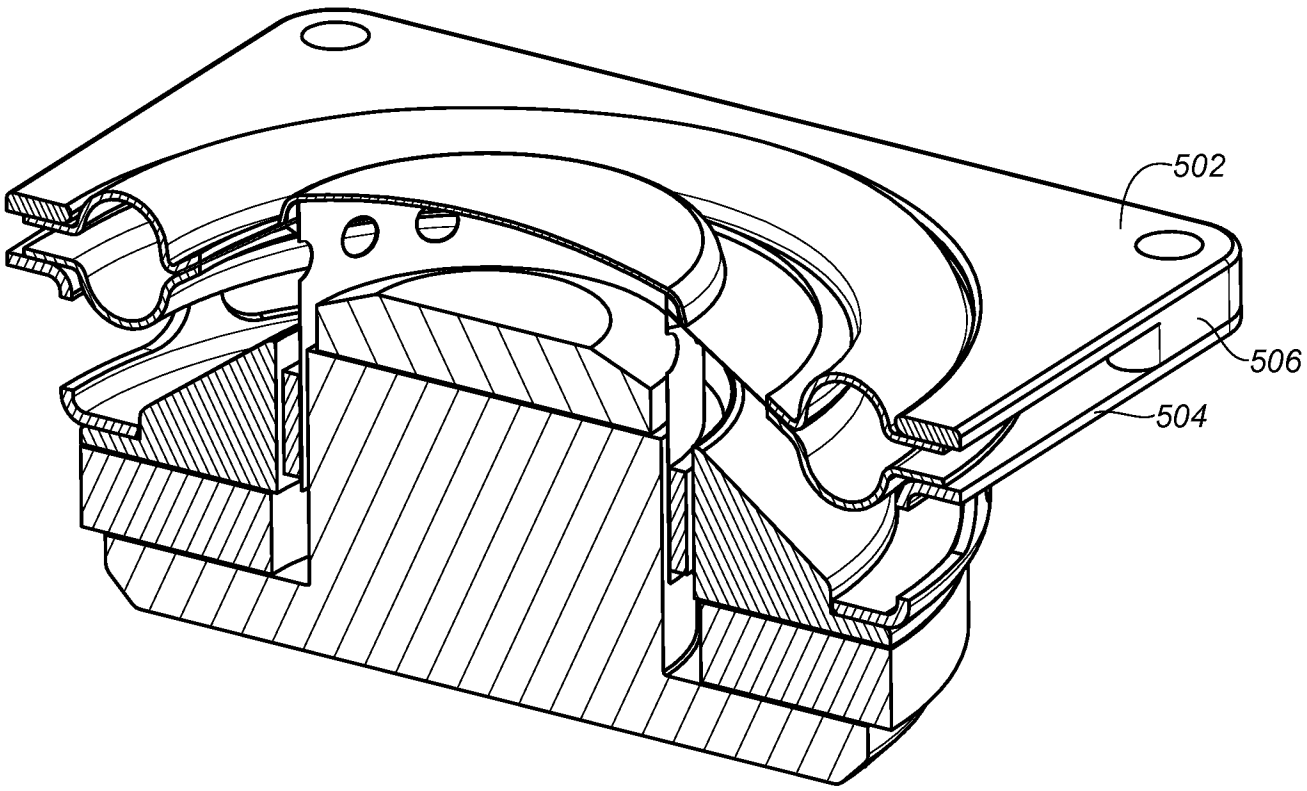

In some examples, as shown in FIGS. 3A and 3B, a spacer element 306 is disposed between the respective outer landings 112 of the opposing pair of surround elements such that the outer edges 108 are separated by a first distance that is defined at least in part by the height of the spacer element 306 while the inner edges 106 are separated by a second distance that is defined at least in part by a thickness of the diaphragm 100. In some implementations, the spacer element 306 is formed of a non-porous material and includes vent holes 308, as shown in FIGS. 3A and 3B, while in other implementations, the spacer element is formed of a non-porous material that does not include any vent holes (not shown). In still other implementations, the spacer element 406 is formed of a porous material, as shown in FIGS. 4A and 4B. Example spacer element materials include plastic, rubber, foam, fabric, and metal. The vented and porous spacer elements 306, 406 of FIGS. 3A, 3B, 4A, and 4B are configured to allow air inside the suspension element 104 to be vented to the external environment. The spacer elements 306, 406 could be a separate component that are coupled to the surround elements using any suitable method (e.g., via an adhesive or by melting the suspension element material to the spacer element, among others). Alternatively, the spacer elements 306, 406 could be formed integrally with the surround elements or with another component (e.g., the frame 102 or other support structure). In some examples, as shown in FIGS. 5A and 5B, the frame of the acoustic device includes an upper frame element 502 and a lower frame element 504 that are separated by a spacer frame element 506. The elements 502, 504, and 506 may be separate and distinct components, as shown in FIGS. 5A and 5B, or formed as a single integral component (not shown). Referring to FIGS. 5A and 5B, the respective outer landings 112 of the opposing pair of surround elements are coupled to the upper and lower frame elements 502, 504 and separated by a distance that is defined at least in part by the height of the spacer frame element 506.

Figure 6A:
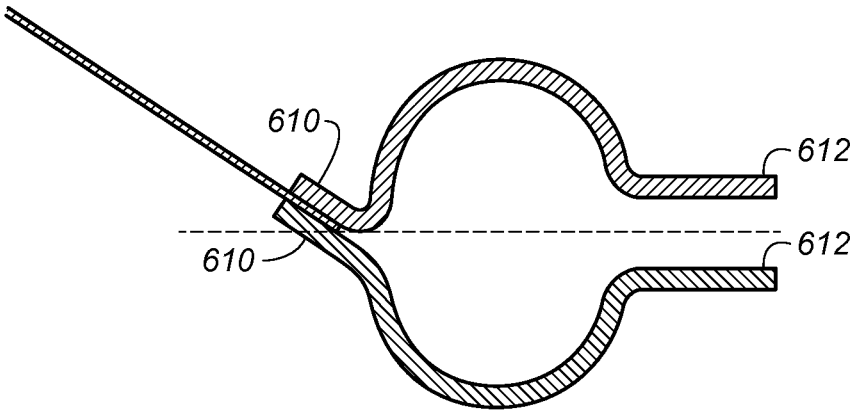
FIG. 6A shows a cross-sectional view of a suspension element with aligned midlines.
Figure 6B:
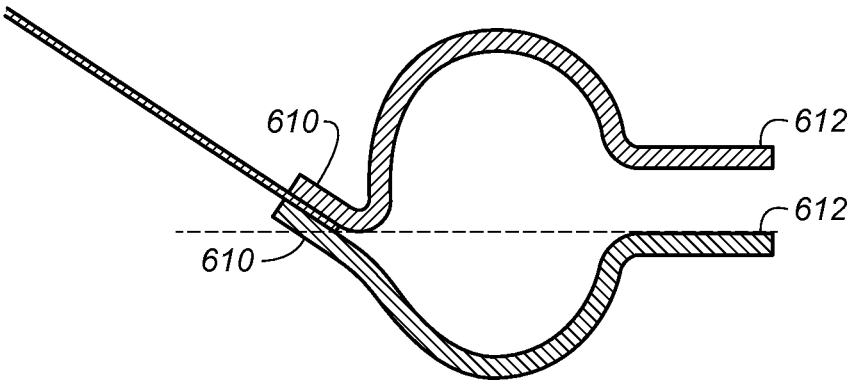
FIG. 6B shows a cross-sectional view of a suspension element with offset midlines.

FIGS. 6A and 6B each show a cross-sectional view of a suspension element of an acoustic device. The suspension elements of FIGS. 6A and 6B could be used, for example, in the acoustic devices shown in FIGS. 1-5. The suspension element of FIG. 6A is formed by a pair of opposing and generally circular half roll surround elements that are arranged such that the midline of the inner landings 610 of the surround elements is aligned with the midline of the outer landings 612 of the surround elements. This is in contrast to the suspension element of FIG. 6B, which is formed by a pair of opposing and generally circular half roll surround elements that are arranged such that the midline of the inner landings 610 is offset from the midline of the outer landings 612.

Figure 7:
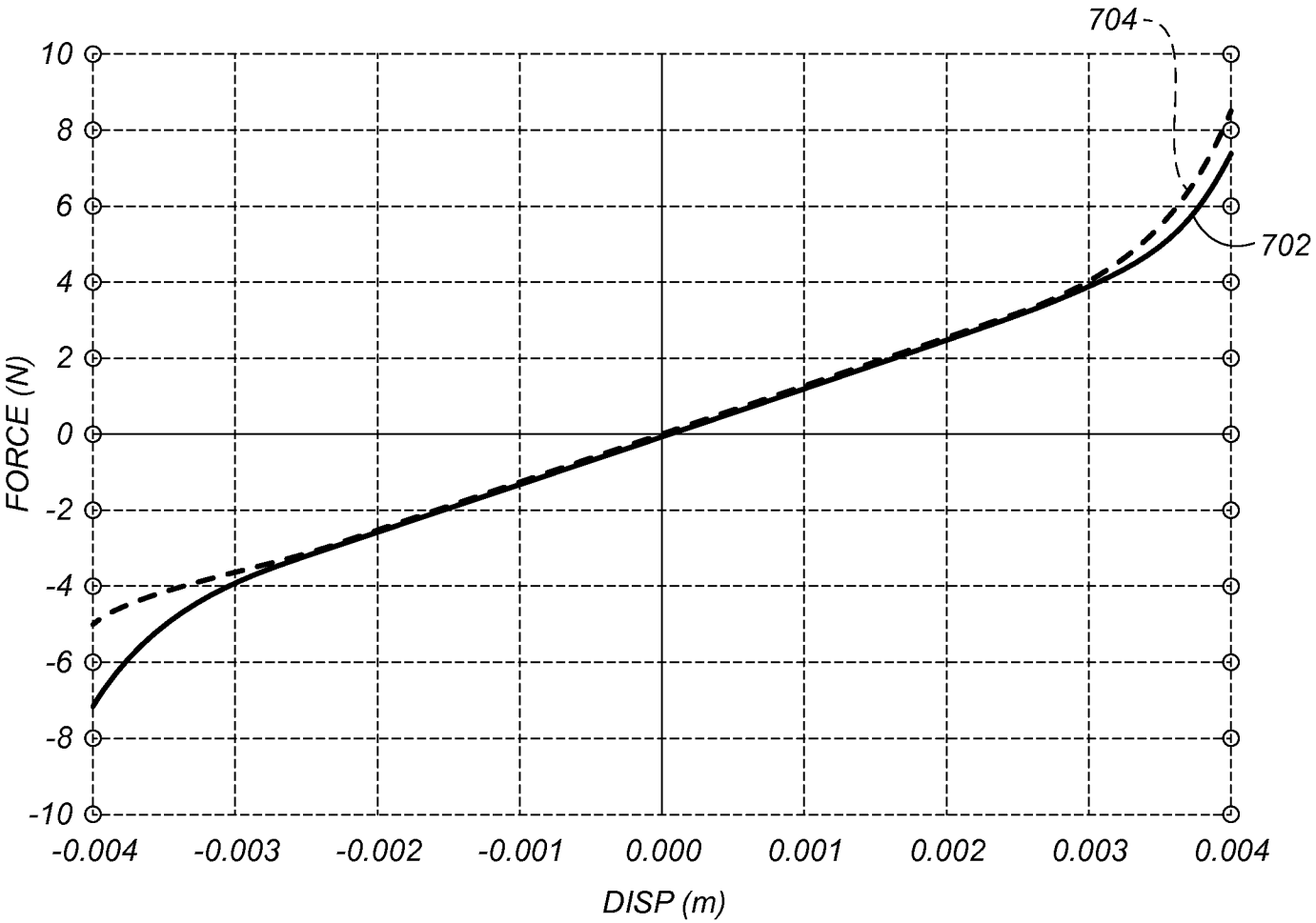
FIG. 7 illustrates an exemplary force versus displacement curve for an acoustic device that includes a spacer element and aligned midlines and an exemplary force versus displacement curve for the same acoustic device with offset midlines.

FIG. 7 illustrates exemplary force versus displacement curves 702, 704 for the acoustic devices of FIGS. 6A and 6B. The solid lined curve 702 in FIG. 7 represents the force-displacement curve for the acoustic device of FIG. 6A; the dash lined curve 704 in FIG. 7 represents the force-displacement curve for the acoustic device of FIG. 6B. As can be seen, the acoustic device of FIG. 6A, which is implemented with a suspension element that has aligned midlines, exhibits more symmetrical force versus displacement in comparison with the acoustic device of FIG. 6B, which is implemented with a suspension element that has offset midlines. The vertical difference between the two curves 702, 704 represents the contribution made by aligning the midlines. Thus, in some examples, in addition to providing a different amount of spacing on the inner edges as compared to the outer edges of the suspension element, it may also be advantageous to align the midlines on the inner and outer edges of the suspension element.

Figure 8:
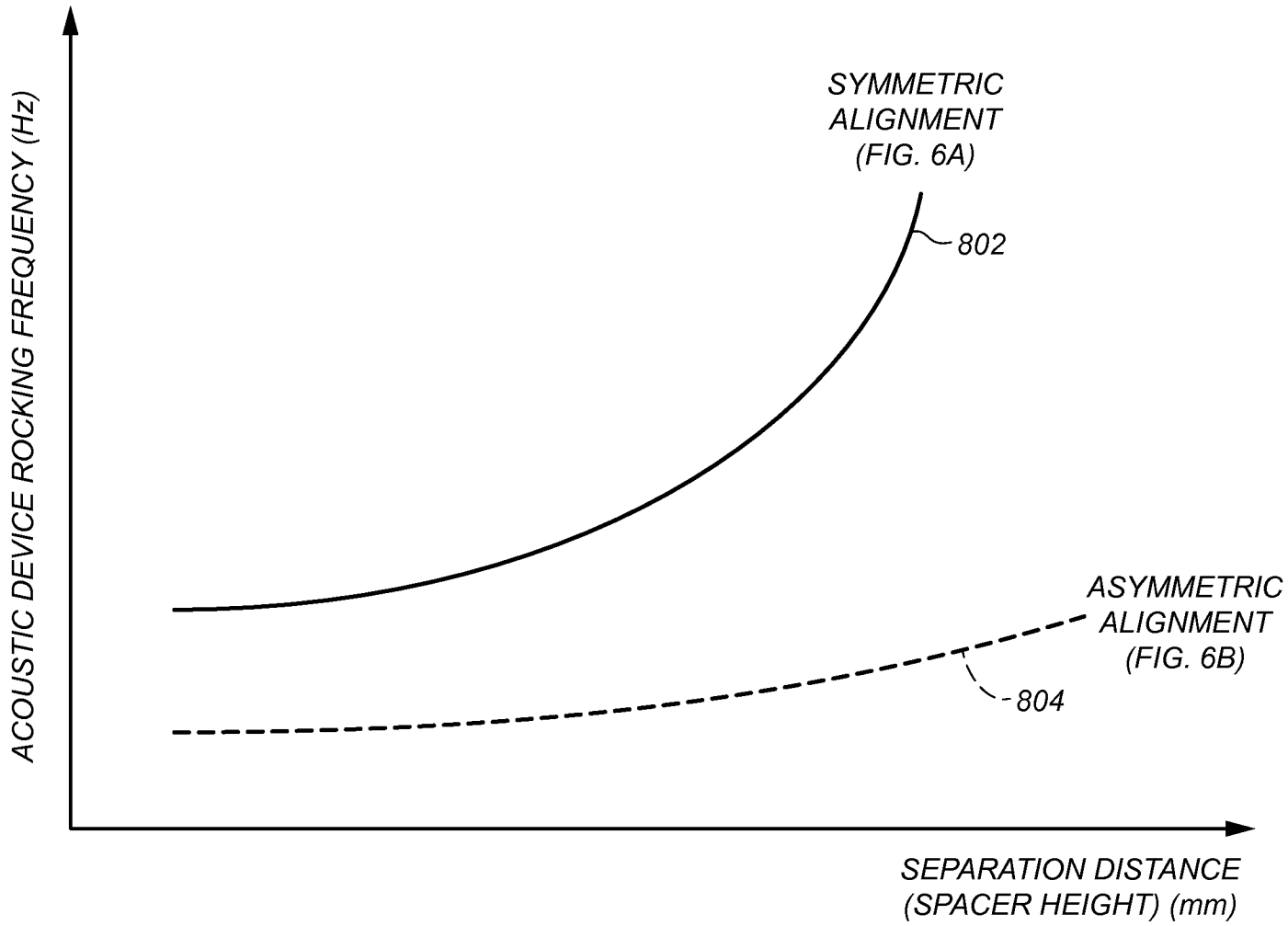
FIG. 8 illustrates an exemplary rocking frequency versus separation distance curve for an acoustic device with aligned midlines and an exemplary rocking frequency versus separation distance curve for an acoustic device with offset midlines.

FIG. 8 illustrates rocking frequency versus separation distance curves 802, 804 for the acoustic devices of FIGS. 6A and 6B. The solid lined curve 802 in FIG. 8 represents the rocking frequency-separation distance curve for the acoustic device of FIG. 6A; the dash lined curve 804 in FIG. 8 represents the rocking frequency-separation distance curve for the acoustic device of FIG. 6B. As can be seen, regardless of the actual separation distance, the acoustic device of FIG. 6A, which is implemented with a suspension element that has aligned midlines, exhibits a higher range of acoustic device rocking frequencies relative to the acoustic device of FIG. 6B, which is implemented with a suspension element that has offset midlines.

Among the wide variety of variations that are contemplated are variations in the placement of the spacer element. For example, the spacer element can be placed between the inner landings (rather than the outer landings) of a suspension element such that the distance separating the inner edges of a suspension element is greater than the distance separating the outer edges. In addition, the amount of separation provided on the inner edges and outer edges of the suspension element could vary. For example, in some implementations, the distance separating one of the inner and outer edges of the suspension element could be approximately three times the distance separating the other of the inner and outer edges of the suspension element. Other relative distances are contemplated, however. The implementations described herein could apply to an active transducer that includes a motor structure (as shown), but could also apply to a passive radiator, sometimes referred to as a drone.

A number of implementations have been described. Nevertheless, it will be understood that additional modifications may be made without departing from the scope of the inventive concepts described herein, and, accordingly, other embodiments are within the scope of the following claims.

What is claimed is:

1. An acoustic device comprising:

a diaphragm a frame;

a suspension element that couples the diaphragm to the frame such that the diaphragm is movable in a reciprocating manner relative to the frame, the suspension element comprising a first surround element and a second surround element that are separated at respective outer edges by a first distance and separated at respective inner edges by a second distance, wherein the first distance and the second distance are different; and a spacer element that is disposed between the first surround element and the second surround element, and wherein the first distance comprises a thickness of the spacer element.

2. The acoustic device of claim 1, wherein the first distance is greater than the second distance.

3. The acoustic device of claim 1, wherein the second distance comprises a thickness of the diaphragm.

4. The acoustic device of claim 1, wherein the spacer element is formed of a non-porous material.

5. The acoustic device of claim 1, wherein the spacer element includes one or a plurality of vents.

6. The acoustic device of claim 1, wherein the spacer element is formed of a porous material.

7. The acoustic device of claim 1, wherein:

each of the first surround element and the second surround element includes a respective outer landing that is defined in part by a respective outer edge, and wherein the spacer element is disposed between the outer landings of the first surround element and the second surround element;

each of the first surround element and the second surround element includes a respective inner landing that is defined in part by a respective inner edge, and wherein the diaphragm is disposed between the inner landings of the first surround element and the second surround element; and the first surround element and the second surround element are arranged such that a midline of the inner landings of the surround elements is aligned with the midline of the outer landings of the surround elements.

8. The acoustic device of claim 1, wherein the frame includes:

a first frame element that is coupled to an outer landing of the first surround element; and a second frame element that is coupled to an outer landing of the second surround element.

9. The acoustic device of claim 8, wherein the frame further includes:

a third frame element that couples the first frame element to the second frame element, wherein the first distance is defined at least in part by a dimension of the third frame element, and wherein the first frame element, the second frame element and the third frame element form an integral unit.

10. The acoustic device of claim 8, wherein:

the diaphragm is disposed between respective inner landings of the first surround element and the second surround element; and the first surround element and the second surround element are arranged such that a midline of the inner landings of the surround elements is aligned with the midline of the outer landings of the surround elements.

11. An acoustic device:

a diaphragm a frame;

a suspension element that couples the diaphragm to the frame such that the diaphragm is movable in a reciprocating manner relative to the frame, the suspension element comprising a first surround element and a second surround element that are separated at respective outer edges by a first distance and separated at respective inner edges by a second distance, wherein the first distance and the second distance are different, and wherein a midline between the inner edges is aligned with a midline between the outer edges; and a spacer element that is disposed between the first surround element and the second surround element, and wherein the first distance comprises a thickness of the spacer element.

12. The acoustic device of claim 11, wherein the first distance is greater than the second distance.

13. The acoustic device of claim 11, wherein the second distance comprises a thickness of the diaphragm.

14. The acoustic device of claim 11, wherein the frame includes:

a first frame element that is coupled to an outer landing of the first surround element; and a second frame element that is coupled to an outer landing of the second surround element.

15. The acoustic device of claim 14, wherein the frame further includes:

a third frame element that couples the first frame element to the second frame element, wherein the first distance is defined at least in part by a dimension of the third frame element, and wherein the first frame element, the second frame element and the third frame element form an integral unit.

* * * * *